US005622070A

United States Patent [19]

Bulso, Jr.

[11] Patent Number: 5,622,070

[45] Date of Patent: Apr. 22, 1997

[54] METHOD OF FORMING A CONTOURED CONTAINER

[75] Inventor: Joseph D. Bulso, Jr., Canton, Ohio

[73] Assignee: Redicon Corporation, Canton, Ohio

[21] Appl. No.: 461,154

[22] Filed: Jun. 5, 1995

[51] Int. Cl.[6] ..... B21D 51/26

[52] U.S. Cl. ..... 72/68; 72/105; 72/379.4

[58] Field of Search ..... 72/68, 105, 349, 72/367, 370, 379.4; 413/69

[56] References Cited

U.S. PATENT DOCUMENTS

| | | | |
|---|---|---|---|
| D. 356,501 | 3/1995 | Kornick, et al. | D9/518 |
| 2,330,556 | 9/1943 | Carlson et al. | 72/370 |
| 3,029,667 | 4/1962 | Sporck | 72/105 |
| 3,951,296 | 4/1976 | Swanson et al. | 72/349 |
| 4,020,670 | 5/1977 | Bulso, Jr. et al. | 72/349 |
| 4,134,285 | 1/1979 | Iaconetti, et al. | 72/84 |
| 4,512,172 | 4/1985 | Abbott et al. | 72/105 |
| 4,522,049 | 6/1985 | Clowes | 72/349 |
| 4,732,031 | 3/1988 | Bulso, Jr. et al. | 72/363 |

FOREIGN PATENT DOCUMENTS

| | | | |
|---|---|---|---|
| 1776477 | 11/1992 | U.S.S.R. | 72/370 |

*Primary Examiner*—Lowell A. Larson
*Attorney, Agent, or Firm*—Reese Taylor

[57] ABSTRACT

A method of forming a drawn and redrawn and ironed container having a contoured sidewall. A cup is blanked and formed from stock in conventional fashion. A profiled bottom may be formed in the cup during the redraw step. The cup is ironed using at least one ironing ring and an ironing punch having at least one recessed area for shaping the interior sidewall of the cup. When the cup is ironed, areas of extra material are formed on the interior of the sidewall where the recessed areas of the ironing punch were present. These areas of extra material are shaped during a spin forming step that creates the contoured sidewall of the can.

15 Claims, 2 Drawing Sheets

FORMING A CUP FROM A GENERALLY CIRCULAR BLANK BY DRAWING AND REDRAWING THE BLANK.

ENGAGING THE INTERIOR OF THE CUP WITH AN IRONING PUNCH, THE IRONING PUNCH HAVING AT LEAST ONE RECESSED AREA DISPOSED ON THE SURFACE OF THE IRONING PUNCH CONTACTING THE INTERIOR OF THE CUP.

PASSING THE CUP AND THE IRONING PUNCH THROUGH AT LEAST ONE IRONING RING TO IRON THE CUP AND THIN THE WALL WHILE LEAVING AN EXCESS THICKNESS OF WALL MATERIAL IN PREDETERMINED AREAS.

SPIN FORMING THE CUP TO EXPAND THE WALL DIAMETER ADJACENT THE PREDETERMINED AREAS TO CREATE A CONTOURED SIDEWALL.

FIG. 1

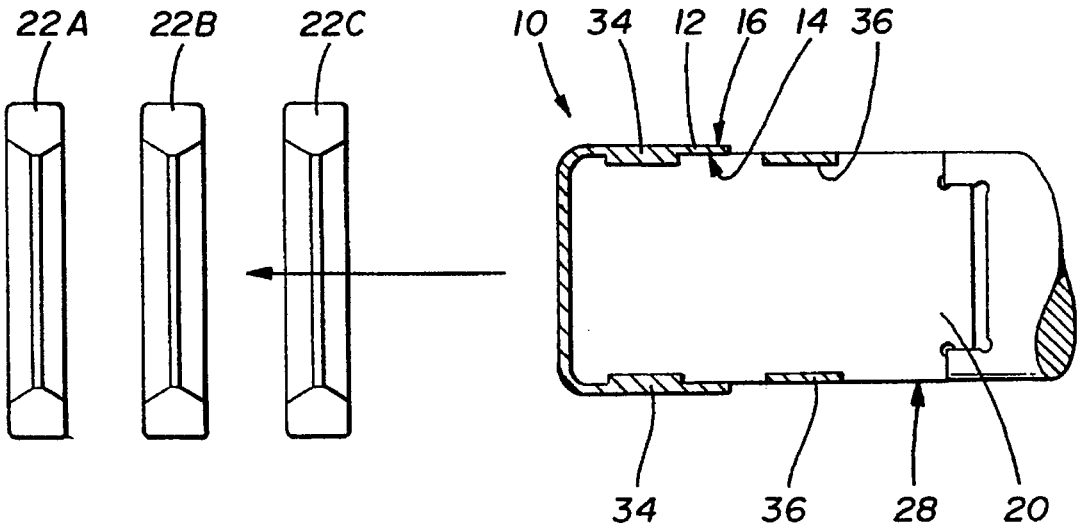

FIG. 2

METHOD OF FORMING A CONTOURED CONTAINER

FIELD OF THE INVENTION

This invention generally relates in general to a method for forming containers. More specifically, the invention relates to a method for forming a container having a contoured sidewall.

BACKGROUND OF THE INVENTION

The large consumer demand for products contained in metal containers creates a correspondingly large demand for metal containers. There are numerous known methods for manufacturing metal containers. These methods produce cans that may be labeled or otherwise decorated in a fashion that is designed to attract consumer attention and convey information.

Cans of the type involved in this application are generally fabricated from three pieces or two pieces. A three piece can comprises a bottom, a top, and a sidewall that are fitted together with at least one joint being welded to form a generally closed, cylindrical unit. The cost of the welding process and the fact that the weldment posed at least a possible contamination problem created a desire for a two-piece can construction.

The two-piece design comprises one drawn piece that comprises the bottom and the sidewall and a second piece that comprises the top. Containers formed by both of these methods normally create straight side walls or, in other words, a cylindrical configuration or, in some cases a conical configuration. Furthermore, the cost of the material used to manufacture the cans has moved the industry to form the cans with increasingly thin material. As the thickness of the material decreases, the ease with which it tears or wrinkles increases. Thus, the machines and methods used to work with this material must take into account that the material will easily wrinkle or tear.

Recently, can purchasers have expressed the desire to purchase a can that has a contoured sidewall. For the purposes of this application, a contoured sidewall is one that has a profile that is not straight. The profile may have a single curve or a plurality of curves. It is believed that cans having a contoured sidewall will be useful for marketing purposes. It is also believed that a can having a contoured sidewall will be attractive to consumers who will identify the contoured can with a specific product. For example, it may be desirable to form a can in the well-known shape of a Coca-Cola beverage bottle. Such a can would enable a consumer to identify the can by its shape as well as by its labeling. An example of such a container may be seen in Kornick Design U.S. Pat. No. 365,501. Another use for a contoured sidewall is to provide portions of the can to assist gripping. These functions are also useful on containers other than metal containers used for beverages. Containers that store food items and other consumer goods will also benefit from having a contoured sidewall.

Known manufacturing methods are not able to economically mass produce containers having a contoured sidewall. One suggested method has been to form a can in a well known manner including the step of ironing the can to initially form the sidewall. An inflatable bladder is then inserted into the can and expanded with compressed air or other fluid substance. The bladder presses outwardly on the sidewall from the inside of the can creating a contoured sidewall. The problem with this process is that the sidewall hardens after it has been ironed. When the bladder is expanded to stretch the hardened wall, the wall tends to split, wrinkle, or crack resulting in rejection of that can. There is, therefore, clearly a need in the art for a method for forming a can having a contoured sidewall utilizing, so far as possible known two piece can forming methods.

SUMMARY OF THE INVENTION

It is, therefore, a primary object of the present invention to provide a method for forming a two piece container having a contoured sidewall.

It is another object of the present invention to provide a method for forming such a container from a cup having areas of extra material positioned on selected areas of the sidewall to facilitate subsequent forming of the contoured areas.

It is also an object of the present invention to provide a method, as above, that forms the areas of extra material disposed on the sidewall by ironing the cup with an ironing punch having recessed areas.

It is a further object of the present invention to provide a method, as above, including the step of spin forming the cup to form contours in the sidewall.

It is still a further object of the invention to provide a method, as above, wherein the spin-forming step applies force to the wall of the container adjacent the areas of the sidewall that have extra material whereby the extra material is forced to bulge out, away from the starting plane of the sidewall to form contours.

These and other objects of the invention, as well as the advantages thereof over existing and prior art forms, which will become apparent in view of the following detailed specification, are accomplished by means hereinafter described and claimed.

In general, a method for producing a container having a contoured sidewall is achieved by engaging a preformed cup on an ironing punch, passing the cup through at least one ironing ring such that a sidewall is formed having areas of extra material, and spin forming the ironed cup to shape said areas of extra material to provide a contoured sidewall.

Yet other objects of the present invention are attained by a method of forming a container having a contoured sidewall comprising the steps of forming a cup from a generally circular blank by drawing and redrawing the blank, engaging an ironing punch with the interior of said cup, said ironing punch having at least one recessed area disposed on the surface of said ironing punch contacting said interior of said cup, passing said cup and said ironing punch through at least one ironing ring, removing said ironing punch from said cup, and spin forming said cup to create a contoured sidewall.

These and other objects of the invention will become more apparent upon reading of the following specification considered in view of the accompanying drawings.

OF THE DRAWINGS

FIG. 1 is a block diagram generally illustrating the steps in the method of the present invention;

FIG. 2 is a schematic side view illustrating the first part of the ironing step of the present invention;

BRIEF DESCRIPTION OF THE PREFERRED EMBODIMENTS

The method according to the present invention is shown in general form in the block diagram of the FIG. 1. The first step involves forming a cup from a generally circular blank. Bulso U.S. Pat. No. 4,732,031 teaches one method for forming such a cup in a double acting press of a type known in the art. The patent discloses that the material is blanked by punching out a generally circular blank with a punch shell. The blank is then wiped and redrawn to form a cup. This operation is generally known in the art as drawing and redrawing the material. Other methods for forming a cup are known in the art and are suitable for use with the present invention.

U.S. Pat. No. 4,732,031 also discloses the steps necessary to form a profiled bottom in the cup. A profiled bottom is generally desirable for adding strength to containers which hold a material under pressure. In situations where a contoured container does not require the extra strength of a profiled bottom, the cup may be formed absent the profiled bottom. A mechanism for forming such a cup is disclosed by U.S. Pat. No. 4,020,670 to Bulso, Jr. et al. The method of the present invention will perform equally well on a cup whether or not a profiled bottom is present.

The second step of forming a container having a contoured sidewall is ironing the cup to create a sidewall having selected areas of extra material. In container-forming processes known in the art, an ironing step is often used to increase the height of the sidewall of the container and to harden the material. An example of an ironing process may be seen in the aforementioned U.S. Pat. No. 4,732,031. That patent teaches that ironing may be used to elongate the cup by placing the cup on a mandrel and passing the cup through one or more ironing rings. When the cup is passed through the rings, the rings thin and stretch the material that forms the sidewall of the cup. The disclosed process, however, only yields smooth, uniform sidewalls that cannot be contoured without damaging the material.

Figure 3:
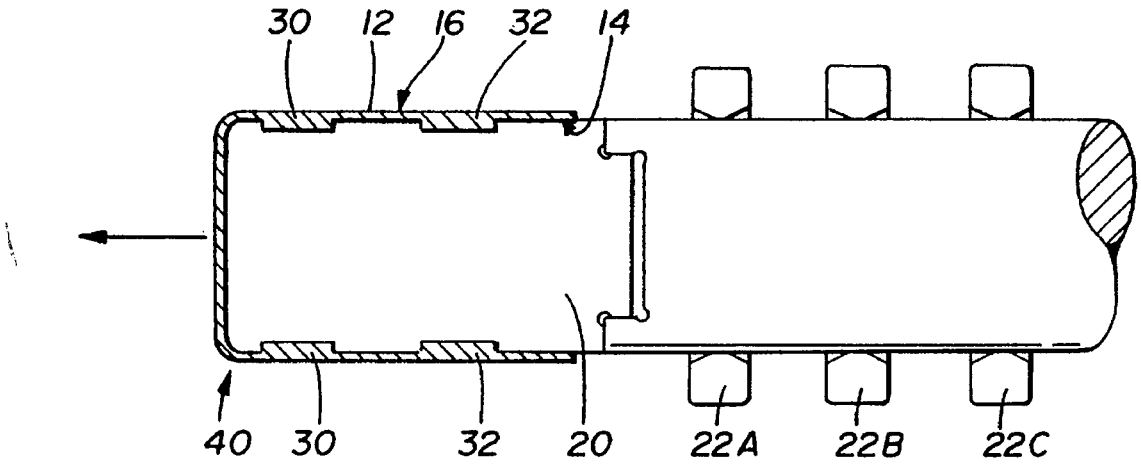
FIG. 3 is a schematic side view illustrating the second part of the ironing step of the present invention.

The present invention uses an ironing process that allows the sidewall of the cup to retain excess material in selected areas that will later be used to form and provide strength to the contoured sidewalls. Referring now to FIGS. 2 and 3, schematic diagrams may be seen generally depicting the ironing step of the present invention. The cup formed by the drawing process is generally designated by the numeral 10. The cup 10 has a sidewall 12 that was formed during the drawing process. The sidewall 12 has an inner surface 14 and an outer surface 16. In the preferred embodiment of the present invention, an ironing punch 20 is inserted into the interior of the cup 10. The ironing punch 20 has an exterior shape that generally matches the interior surface of the cup 10 with an important exception which will be hereinafter explained. The ironing punch 20 supports the cup 10 as it passes through the ironing ring 22 and prevents the sidewall 12 of the cup 10 from wrinkling or collapsing. When a cup 10 having a profiled bottom is involved, a doming post and a pressure sleeve about the closed end of the cup 10. The doming post and the pressure sleeve could be used to hold the form of the bottom of the cup 10 while it is being ironed.

The combination of the cup 10 and the ironing punch 20 are then passed through at least one ironing ring 22 that has an inside diameter that is slightly smaller than the outside diameter of the cup 10. The ironing ring 22 elongates the cup sidewall 12 by stretching the sidewall material. A plurality of ironing rings 22A, 22B, 22C may be used when necessary to adequately complete the ironing process. The number and configuration of the ironing rings 22 depend on the material being ironed, the shape of the cup 10, and the desired shape of the ironed cup. By ironing in accordance with this method, the cup sidewall 12 will assume the form of the ironing punch 20 and the ironing ring 22. Thus, if an ironing ring 22 is used that has a smooth, circular inner surface, the outer surface 16 of the sidewall 12 will be smooth and circular. Similarly, the inner surface 14 of the sidewall 12 will resemble the outer surface 28 of the ironing punch 20.

The ironing process of the present invention prepares the cup 10 for accepting a contoured sidewall by shaping the sidewall 12 in a manner that leaves extra sidewall material on the inside surface 14 of the sidewall 12. The extra material is then used to provide a shaping area for the contoured wall. The areas of extra material 30 and 32 are achieved by providing an ironing punch 20 that has recessed areas 34 and 36 that match the desired areas of extra material 30 and 32. When this type of ironing punch 20 is used in the ironing process, the ironing rings 22 press the sidewall material into the recessed areas 34 and 36. When the ironing punch 20 is removed from the cup 10, the interior surface 14 of the sidewall 12 has areas 30 and 32 that bulge out away from the interior surface 14 of the sidewall 12. The ironing punch 20 may be removed because the height of the bulges 30 and 32 is relatively small. In one embodiment of the present invention, the bulge height is approximately 0.001 inches on a sidewall 12 having a thickness of approximately 0.0039 to 0.0041 inches. The material that is used to make the cup 10 is also flexible enough that the ironing punch 20 may be removed without damaging the ironed cup 40.

The shape and location of the areas of extra material 30 and 32 depend on the properties of the material and the desired final shape of the contoured sidewall. In the embodiment of the present invention illustrated, the ironing punch 20 has recessed areas 34 and 36 in the form of two annular bands. The resulting ironed cup 40 has two bands of extra material 30 and 32 protruding from the interior surface 14 of the sidewall 12. These bands of extra material 30 and 32 are then contoured such that the resulting can profile resembles the well known Coca-Cola beverage bottle shape referred to above.

However, it will be understood that virtually any desired configuration could be provided. One alternative embodiment of the present invention uses an ironing punch having an annular recess disposed around the area of the ironing punch that contacts the bottom edge of the sidewall. When a can is ironed with this ironing punch, an annular band of extra material is present at the bottom of the ironed cup. This area of the sidewall may then be contoured as will hereinafter be more fully explained.

Another alternative embodiment of the area of extra material may provide a series of annular bands that are evenly spaced along the length of the sidewall. This type of sidewall would be formed by an ironing punch having a plurality of annular recessed areas evenly spaced along the area where the sidewall is formed.

The protruding areas of extra material 30 and 32 on the inner surface 14 of the sidewall 12 may smoothly merge with the inner surface 14 of the sidewall 12 or may meet the sidewall 12 at sharper angles as shown in FIG. 3. The cross section of the areas of extra material 30 and 32 chiefly depends on the desired shape of the contour.

Figure 4:
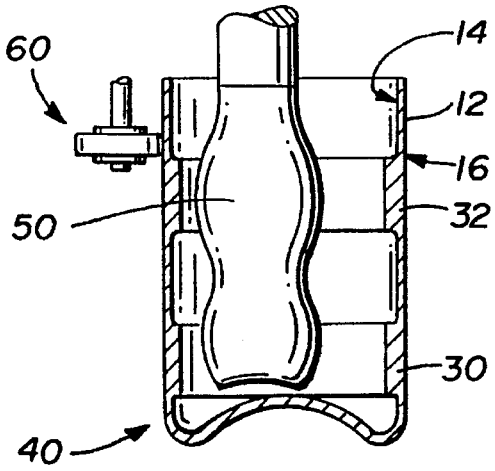
FIG. 4 is a schematic side view illustrating the spin forming step of the present invention.

The contours are formed in the final step of the present invention. The final step is spin forming the ironed cup 40 to contour the sidewall 12. One known application of spin forming is to form multiple groove pulleys and is disclosed by Iaconetti U.S. Pat. No. 4,134,285. The spin forming step in the present invention, schematically depicted in FIG. 4, includes the steps of supporting the ironed cup 40 and inserting a mandrel 50 into the opening of the cup 10. The ironed cup 40 may be supported by conventional means as shown at 54. The mandrel 50 is used for contacting the sidewall 12 and assisting in the formation of the contours. The mandrel 50 may be rotating or may be stationary. The mandrel 50 has a profile that matches the profile desired to be generated in the finished container sidewall. After the mandrel 50 has been inserted and positioned inside the ironed cup 40, a shaping roller 60 is brought into contact with the outside surface 16 of the cup sidewall 12. One portion of the sidewall 12 is thus disposed between the shaping roller 60 and the mandrel 50.

Once both the shaping roller 60 and the mandrel 50 are positioned, at least the shaping roller 60, the ironed cup 40, or the mandrel 50 is rotated. It may also be desirable to rotate more than one of these components at the same time to improve the contouring process. The force exerted by the shaping roller 60 on the outer surface 16 of the sidewall 12 causes the sidewall 12 to take the form of the outer surface 16 of the mandrel 50. The mandrel 50 is formed to anticipate the areas of extra material 30 and 32 on the inner surface 14 of the ironed cup 40. Thus, when the shaping roller 60 exerts force adjacent an area of the sidewall 12, that area has the extra material that allows the material to be forced outwardly and the sidewall 12 to be formed without tearing or wrinkling as a normally-formed sidewall would.

Figure 5:
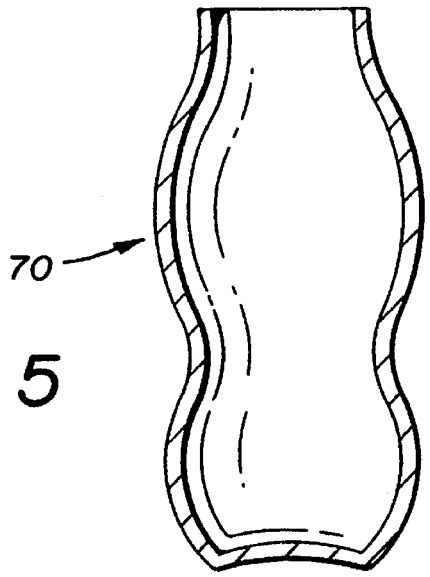
FIG. 5 is a sectional side view of a container having a contoured side wall formed by the method of the present invention.

After the shaping roller 60 has completely contoured the sidewall 12, the shaping roller 60 and the mandrel 50 are removed. The ironed and shaped cup 70, as shown in cross section in FIG. 5, may then be filled with a desired contents and the top secured by a conventional method.

While a full and complete description of the invention has been set forth in accordance with the dictates of the Patent Statutes, it should be understood that modifications can be resorted to without departing from the spirit hereof or the scope of the appended claims.

What is claimed is:

1. A method of forming a container having a contoured sidewall from a cup blank, the cup blank having a base and a sidewall having a first end adjacent the base and a second end adjacent the open end of the cup, the method comprising the steps of:

(a) engaging an ironing punch with the interior of the cup;

(b) passing the ironing punch and the cup through at least one ironing ring such that areas of extra material are formed in the sidewall of the ironed cup between the first end and the second end of the sidewall; and (c) spin forming the ironed cup to shape said areas of extra material to provide a contoured sidewall.

2. A method of forming a container having a contoured sidewall according to claim 1, wherein said ironing punch has at least one recessed area.

3. A method of forming a container having a contoured sidewall according to claim 2, wherein said ironing rings force the sidewall of the cup into said recessed area of said ironing punch when said ironing punch and cup are passed through at least one said ironing ring resulting in areas of extra material being formed on the inside surface of the sidewall.

4. A method of forming a container having a contoured sidewall according to claim 1, wherein the step of spin forming the ironed cup comprises the steps of:

(a) supporting the ironed cup;

(b) inserting a mandrel into said ironed cup;

(c) engaging a shaping roller with the outside surface of the sidewall of said cup; and (d) rotating at least one of said ironed cup, said mandrel, or said shaping roller to contour the sidewall of said ironed cup.

5. A method of forming a container having a contoured sidewall according to claim 4, wherein said shaping roller exerts force on the outer surface of the sidewall of said ironed cup.

6. A method of forming a container having a contoured sidewall according to claim 4, wherein said shaping roller engages the outer surface of the sidewall of said ironed cup in the location of said areas of extra material are disposed.

7. A method of forming a container having a contoured sidewall according to claim 4, further comprising the steps of:

removing said mandrel after said spin forming step is complete;

(a) filling said ironed and shaped cup; and (b) attaching a lid to said ironed, shaped, and filled cup.

8. A method of forming a container having a contoured sidewall comprising the steps of:

(a) forming a cup having a base and a sidewall, the sidewall having a first end adjacent the base and a second end adjacent the open end, the cup formed from a generally circular blank by drawing and redrawing said blank;

(b) engaging an ironing punch with the interior of said cup, said ironing punch having at least one recessed band disposed on the surface of said ironing punch contacting said interior of said cup;

(c) passing said cup and said ironing punch through at least one ironing ring to form a band of extra material on the inner surface of the cup that substantially corresponds to the recessed band of the ironing punch;

(d) removing said ironing punch from said cup; and (e) spin forming said cup to form at least the band of extra material to create a sidewall having a substantially continuous curved from the first end to the second end of the sidewall.

9. A method of forming a container having a contoured sidewall according to claim 8, wherein the step of spin forming the ironed cup comprises the steps of:

(a) supporting the ironed cup;

(b) inserting a mandrel into said ironed cup;

(c) engaging a shaping roller with the outside surface of the sidewall; and (d) rotating at least one of said ironed cup, said mandrel, or said shaping roller to contour the sidewall of said ironed cup.

10. A method of forming a container having a contoured sidewall according to claim 9 wherein:

(a) said mandrel has a profile that matches the desired profile of the contoured can;

(b) said shaping roller exerts force on the outside surface of the sidewall of said ironed cup; and (c) said shaping roller engages the sidewall of said ironed cup adjacent locations where said areas of extra material are disposed.

11. A method of forming a container having a contoured sidewall according to claim 10, further comprising the steps of:

(a) removing said mandrel after said spin forming step is complete;

(b) filling said ironed and shaped cup; and (c) attaching a lid to said ironed, shaped, and filled cup.

12. A method of forming a container having a contoured sidewall comprising the steps of:

(a) forming a cup from a generally circular blank by drawing and redrawing said blank;

(b) engaging an ironing punch with the interior of said cup, said ironing punch having at least one recessed area disposed on the surface of said ironing punch contacting said interior of said cup;

(c) passing said cup and said ironing punch through at least one ironing ring;

(d) removing said ironing punch from said cup;

(e) supporting said cup;

(f) inserting a mandrel into the interior of said cup, the mandrel being substantially the same length as the sidewall;

(g) engaging a shaping roller with the exterior of said cup; and (h) rotating at least one of the shaping roller, the mandrel, or the cup to create a contoured sidewall.

13. A method of forming a container having a contoured sidewall according to claim 12, wherein areas of extra material are formed on the inside surface of the sidewall of said cup when said cup and said ironing punch are passed through said at least one ironing ring.

14. A method of forming a container having a contoured sidewall according to claim 13, wherein said shaping roller exerts force on the outside surface of said cup where said areas of extra material are disposed.

15. A method of forming a container having a contoured sidewall according to claim 14, further comprising the steps of:

(a) removing said mandrel after said spin forming step is complete;

(b) filling said ironed and shaped cup; and (c) attaching a lid to said ironed, shaped, and filled cup.

* * * * *